US007367628B1

(12) United States Patent
Tsai

(10) Patent No.: US 7,367,628 B1
(45) Date of Patent: May 6, 2008

(54) ARMREST THAT WILL NOT PRODUCE NOISE DURING ADJUSTMENT

(76) Inventor: Po-Chuan Tsai, 226-16, Zhung Zhou, Zhungsheng Cun, Rende Hsiang, Tainan Hsien (TW)

( * ) Notice: Subject to any disclaimer, the term of this patent is extended or adjusted under 35 U.S.C. 154(b) by 0 days.

(21) Appl. No.: 11/725,052

(22) Filed: Mar. 16, 2007

(51) Int. Cl.
*A47C 7/54* (2006.01)

(52) U.S. Cl. ..... 297/411.35

(58) Field of Classification Search ..... 297/411.35, 297/411.37, 411.2; 248/118, 118.1
See application file for complete search history.

(56) References Cited

U.S. PATENT DOCUMENTS 6,908,158 B2 * 6/2005 Willette et al. ..... 297/411.37
7,150,504 B1 * 12/2006 Lee ..... 297/411.35
7,159,947 B1 * 1/2007 Lee ..... 297/411.37
7,201,450 B1 * 4/2007 Chen ..... 297/411.37
2002/0036422 A1 * 3/2002 Prince et al. ..... 297/411.35
2006/0238011 A1 * 10/2006 Bedford et al. ..... 297/411.35
2006/0250018 A1 * 11/2006 Tsai ..... 297/411.36

* cited by examiner

*Primary Examiner*—Milton Nelson, Jr.
(74) *Attorney, Agent, or Firm*—Alan Kamrath; Kamrath & Associates PA

(57) ABSTRACT

An armrest includes an armrest support having a locking seat formed with a plurality of locking grooves, a sliding seat movably mounted on the locking seat, and a push button movably mounted on the sliding seat and having a first end formed with a locking portion detachably locked in one of the locking grooves and a second end formed with a push portion. Thus, the locking portion of the push button is detached from the respective locking groove of the locking seat when the sliding seat is movable relative to the locking seat so that the sliding seat will not rub the locking seat during movement of the sliding seat, thereby preventing from producing a noise during adjustment of the armrest.

20 Claims, 8 Drawing Sheets

ARMREST THAT WILL NOT PRODUCE NOISE DURING ADJUSTMENT

BACKGROUND OF THE INVENTION

1. Field of the Invention

The present invention relates to an armrest and, more particularly, to an armrest for a chair.

2. Description of the Related Art

A conventional armrest 1 in accordance with the prior art shown in FIG. 8 comprises a base 10 having two opposite sides each formed with a stepped receiving chamber 11, a substantially inverted U-shaped positioning seat 14 slidably mounted on the base 10 and having an inside formed with a channel 15 which has two opposite sides each formed with a plurality of positioning grooves 16, two positioning balls 13 each mounted in a respective receiving chamber 11 of the base 10 and each detachably positioned in one of the positioning grooves 16 of the positioning seat 14, and two springs 12 each mounted in a respective receiving chamber 11 of the base 10 and each biased between a respective positioning ball 13 and a wall of respective receiving chamber 11 of the base 10 to push the respective positioning ball 13 toward the respective positioning groove 16 of the positioning seat 14. Thus, a user can apply a force on the positioning seat 14 to move the positioning seat 14 relative to the base 10 to adjust the position of the positioning seat 14 relative to the base 10 so as to adjust the position of the armrest. At this time, each of the positioning balls 13 is positioned in one of the positioning grooves 16 of the positioning seat 14, so that the positioning seat 14 is positioned on the base 10 temporarily.

However, a click sound is easily produced when each of the positioning balls 13 is inserted into one of the positioning grooves 16 of the positioning seat 14 during movement of the positioning seat 14 relative to the base 10, so that noise is easily produced during adjustment of the position of the armrest, thereby causing an uncomfortable sensation to the user.

BRIEF SUMMARY OF THE INVENTION

In accordance with the present invention, there is provided an armrest, comprising an armrest support having a top provided with a locking seat which has a first side formed with a plurality of locking grooves, a sliding seat movably mounted on the locking seat of the armrest support, a push button movably mounted on the sliding seat and having a first end formed with a locking portion extended through the sliding seat and detachably locked in one of the locking grooves of the locking seat and a second end formed with a push portion protruded outwardly from the sliding seat, and an armrest body secured on the sliding seat to move the sliding seat relative to the locking seat of the armrest support.

The primary objective of the present invention is to provide an armrest that will not produce noise during adjustment.

Another objective of the present invention is to provide an armrest, wherein the locking portion of the push button is detached from the respective locking groove of the locking seat when the sliding seat is movable relative to the locking seat of the armrest support so that the sliding seat will not rub the locking seat of the armrest support during movement of the sliding seat, thereby preventing from producing a noise during adjustment of the position of the armrest body relative to the armrest support.

A further objective of the present invention is to provide an armrest, wherein the sliding seat is unlocked from the locking seat of the armrest support by pressing the push portion of the push button, so that a user can adjust the position of the armrest body relative to the armrest support easily and quickly.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
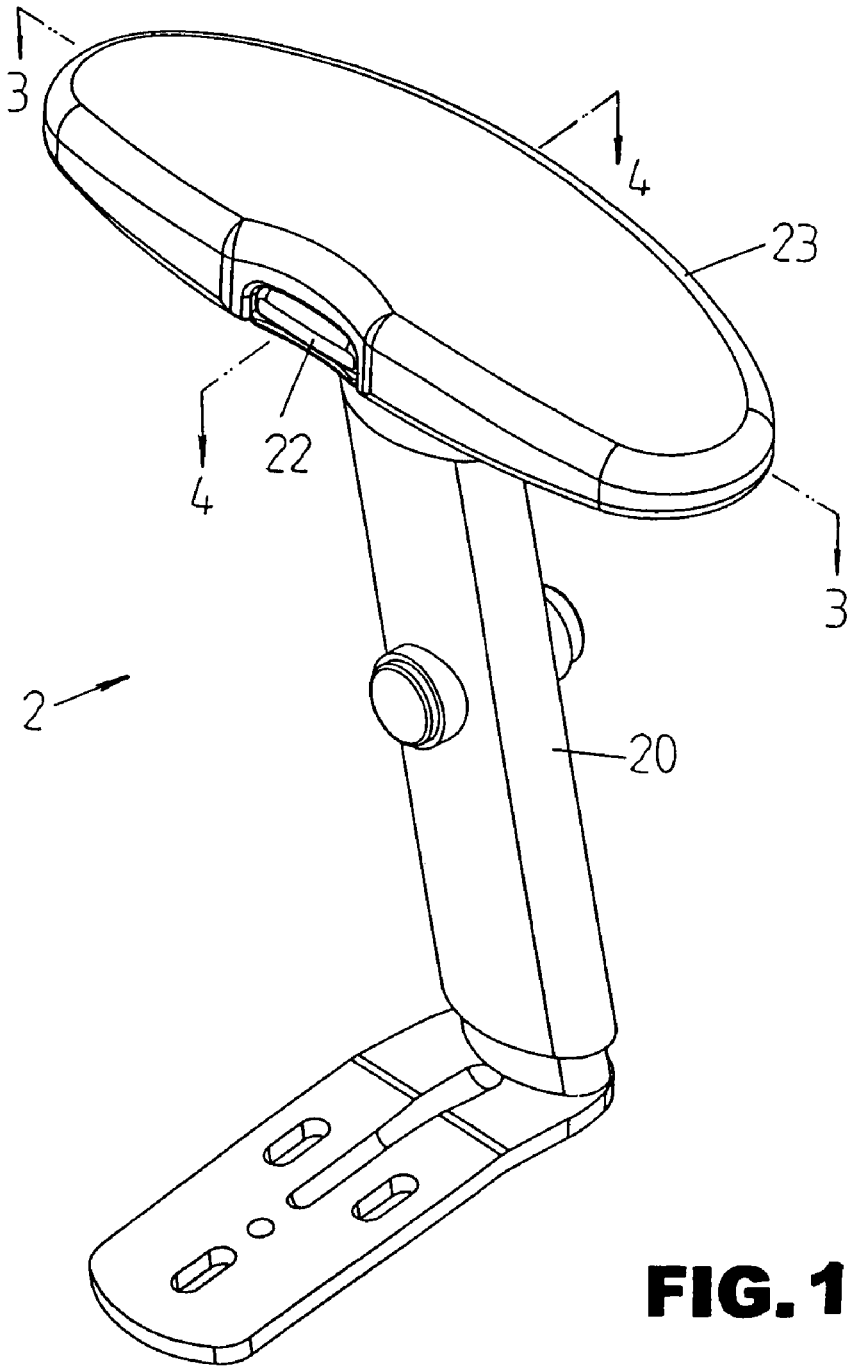
FIG. 1 is a perspective view of an armrest in accordance with the preferred embodiment of the present invention.
Figure 2:
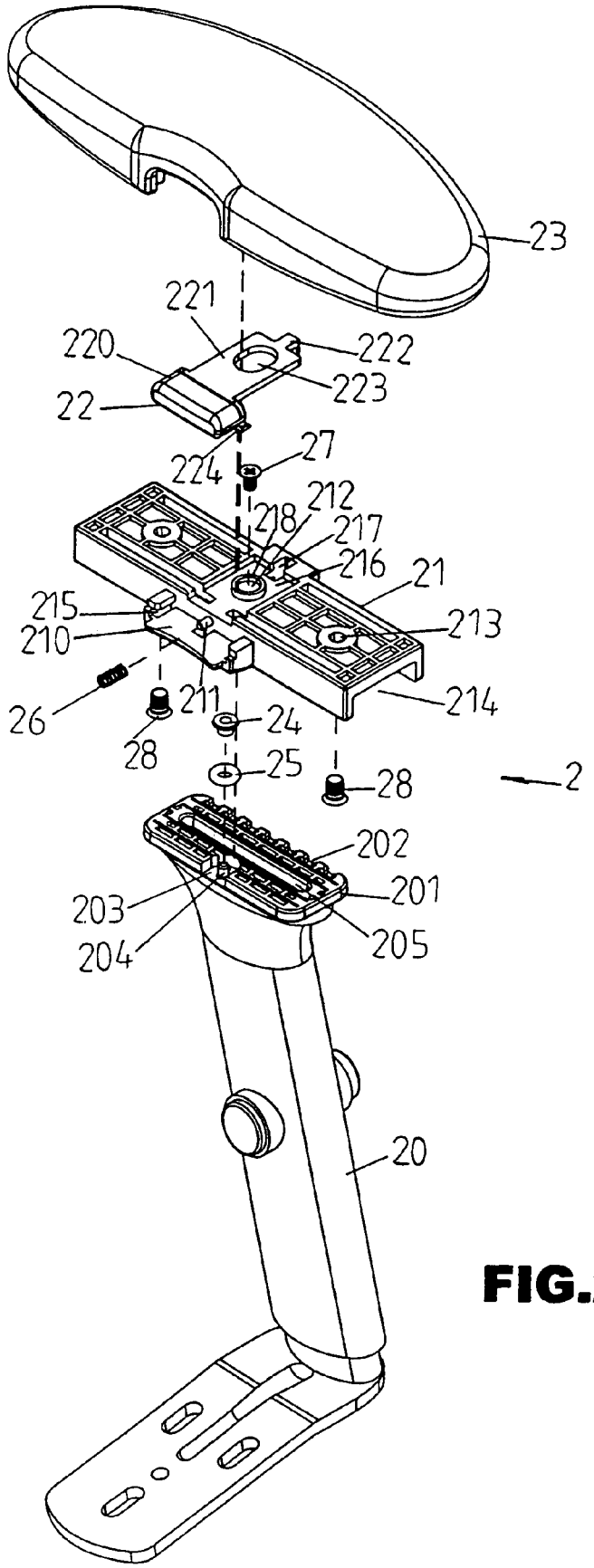
FIG. 2 is an exploded perspective view of the armrest as shown in FIG. 1.
Figure 3:
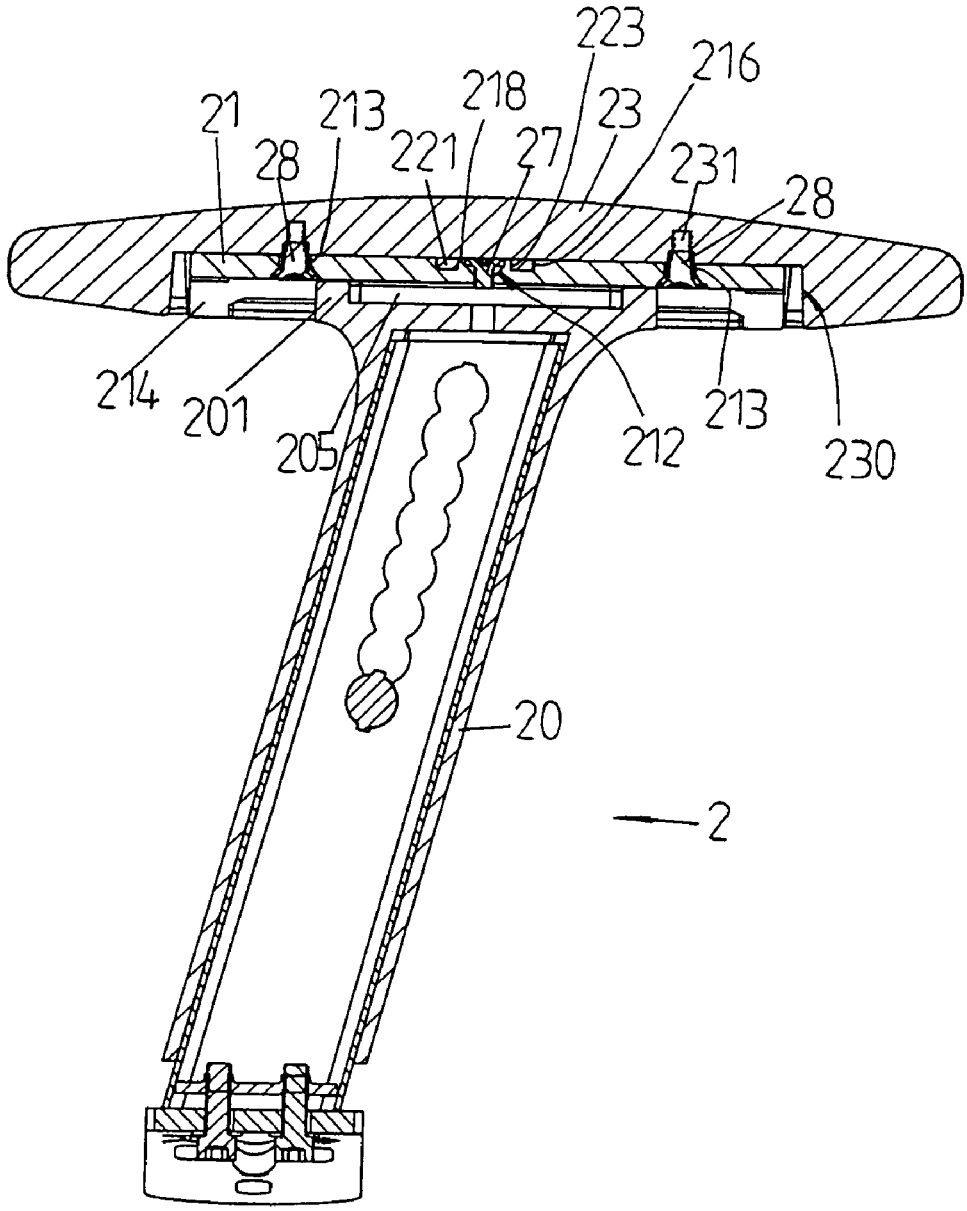
FIG. 3 is a front cross-sectional view of the armrest taken along line 3-3 as shown in FIG. 1.

Referring to the drawings and initially to FIGS. 1-5, an armrest 2 in accordance with the preferred embodiment of the present invention comprises an armrest support 20 having a top provided with a locking seat 201 which has a first side formed with a plurality of locking grooves 202, a sliding seat 21 movably mounted on the locking seat 201 of the armrest support 20, a push button 22 movably mounted on the sliding seat 21 and having a first end 221 formed with a locking portion 222 extended through the sliding seat 21 and detachably locked in one of the locking grooves 202 of the locking seat 201 and a second end formed with a push portion 220 protruded outwardly from the sliding seat 21, and an armrest body 23 secured on the sliding seat 21 to move the sliding seat 21 relative to the locking seat 201 of the armrest support 20.

The locking seat 201 of the armrest support 20 has a second side formed with a receiving groove 203 to receive a roller 24 and a ring 25 which are located between the sliding seat 21 and the locking seat 201 of the armrest support 20 to facilitate movement of the sliding seat 21. The receiving groove 203 of the locking seat 201 is formed with a post 204 for mounting the roller 24 and the ring 25. The locking seat 201 of the armrest support 20 has a mediate portion formed with an axially extending elongated guide slot 205 located between the locking grooves 202 and the receiving groove 203.

The sliding seat 21 has a bottom formed with a channel 214 mounted on the locking seat 201 of the armrest support 20. The channel 214 of the sliding seat 21 is formed with two inwardly extending limit flanges 2140 rested on the locking seat 201 of the armrest support 20 to prevent the sliding seat 21 from being detached from the locking seat 201 of the armrest support 20. The sliding seat 21 has a first side formed with an elongated sliding slot 217 connected to one of the locking grooves 202 of the locking seat 201 to allow sliding movement of the locking portion 222 of the push button 22 and a second side formed with a support bracket 210 to support the push portion 220 of the push button 22. The support bracket 210 of the sliding seat 21 has two opposite sides each formed with a slideway 215. The second side of the sliding seat 21 is formed with a stub 211 for mounting a spring 26 which is biased between the sliding seat 21 and the push portion 220 of the push button 22 to push the push portion 220 of the push button 22 outwardly relative to the sliding seat 21. The sliding seat 21 has a top formed with a receiving chamber 216 connected to the sliding slot 217 to receive the first end 221 of the push button 22. The receiving chamber 216 of the sliding seat 21 is formed with a guide tube 218 having an inside formed with a screw bore 212 connected to the guide slot 205 of the locking seat 201, and a guide screw 27 is screwed into the screw bore 212 of the sliding seat 21 and slidable in the guide slot 205 of the locking seat 201 to guide movement of the sliding seat 21. The sliding seat 21 has two opposite ends each formed with a fixing hole 213.

The push button 22 is retained on the sliding seat 21 to move with the sliding seat 21. The first end 221 of the push button 22 is formed with an elongated sliding hole 223 located between the push portion 220 and the locking portion 222 and mounted on the guide tube 218 of the sliding seat 21 to allow sliding movement of the guide tube 218 of the sliding seat 21. The locking portion 222 of the push button 22 is inverted L-shaped. The push portion 220 of the push button 22 has two opposite sides each formed with a slide 224 slidable in the slideway 215 of the support bracket 210.

The armrest body 23 has a bottom formed with a mounting recess 230 mounted on the sliding seat 21. The mounting recess 230 of the armrest body 23 has a wall formed with two screw holes 231, and the armrest further comprises two locking screws 28 each extended through a respective fixing hole 213 of the sliding seat 21 and each screwed into a respective screw hole 231 of the armrest body 23 to fix the armrest body 23 on the sliding seat 21.

Figure 4:
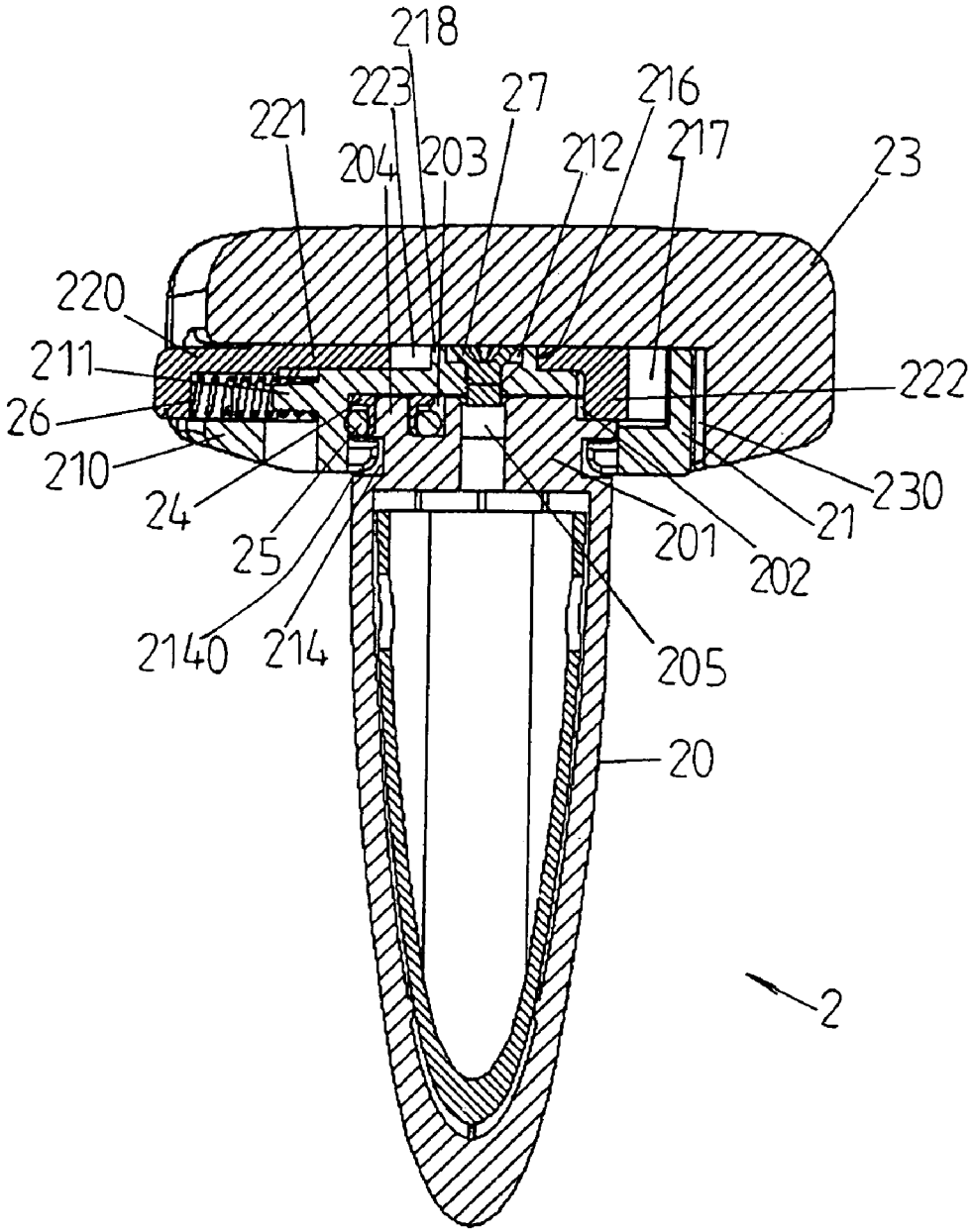
FIG. 4 is a side cross-sectional view of the armrest taken along line 4-4 as shown in FIG. 1.
Figure 5:
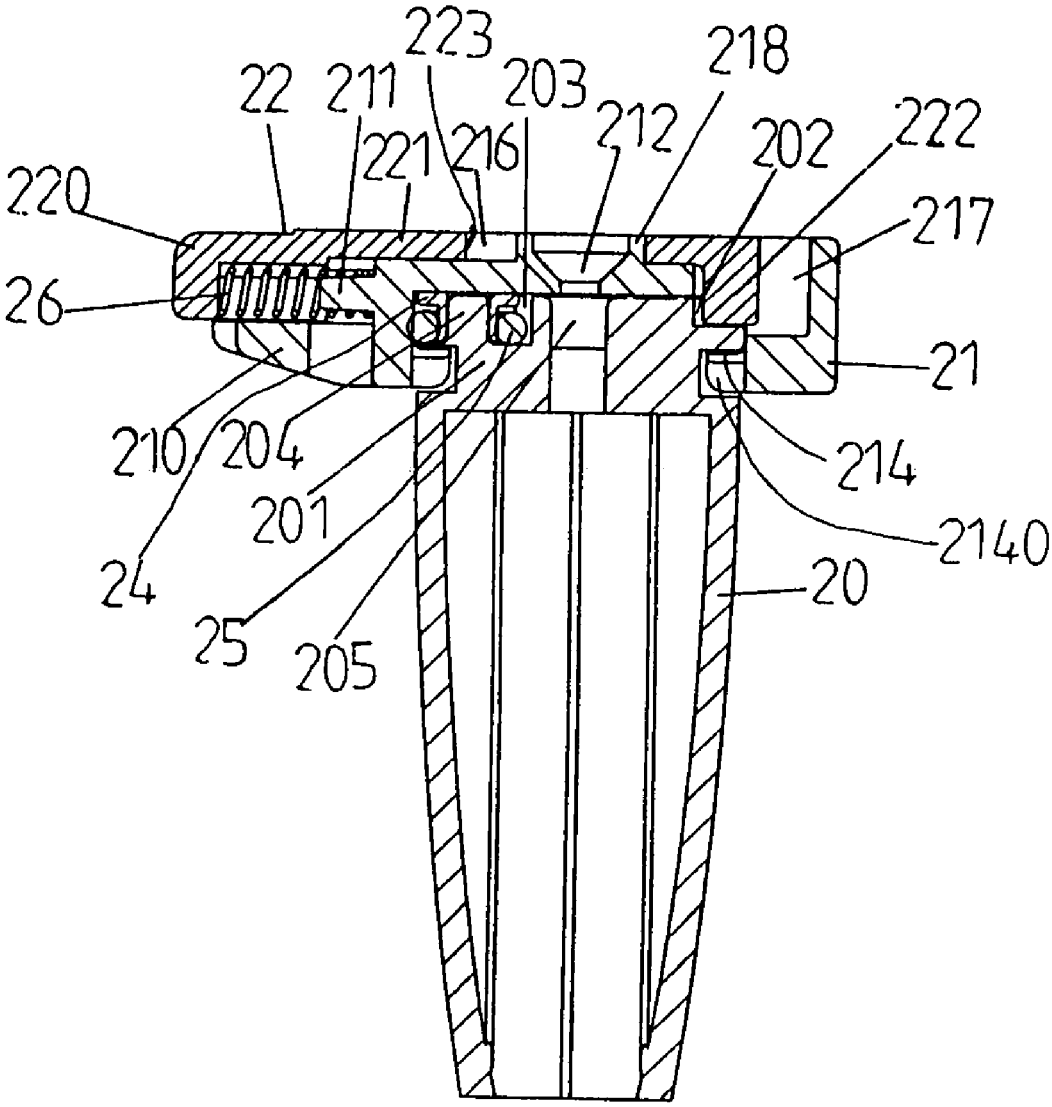
FIG. 5 is a locally enlarged view of the armrest as shown in FIG. 4.
Figure 6:
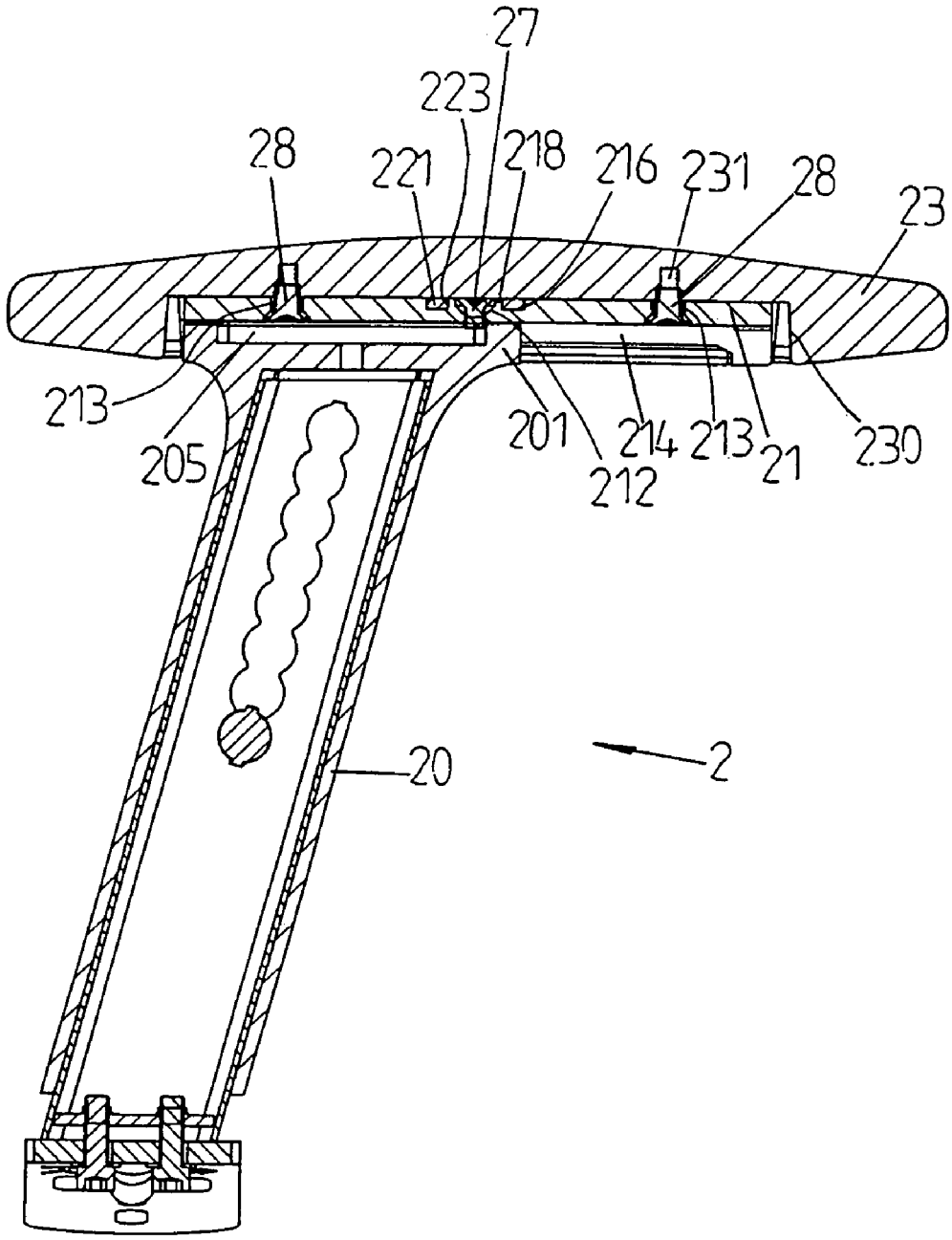
FIG. 6 is a schematic operational view of the armrest as shown in FIG. 3.
Figure 7:
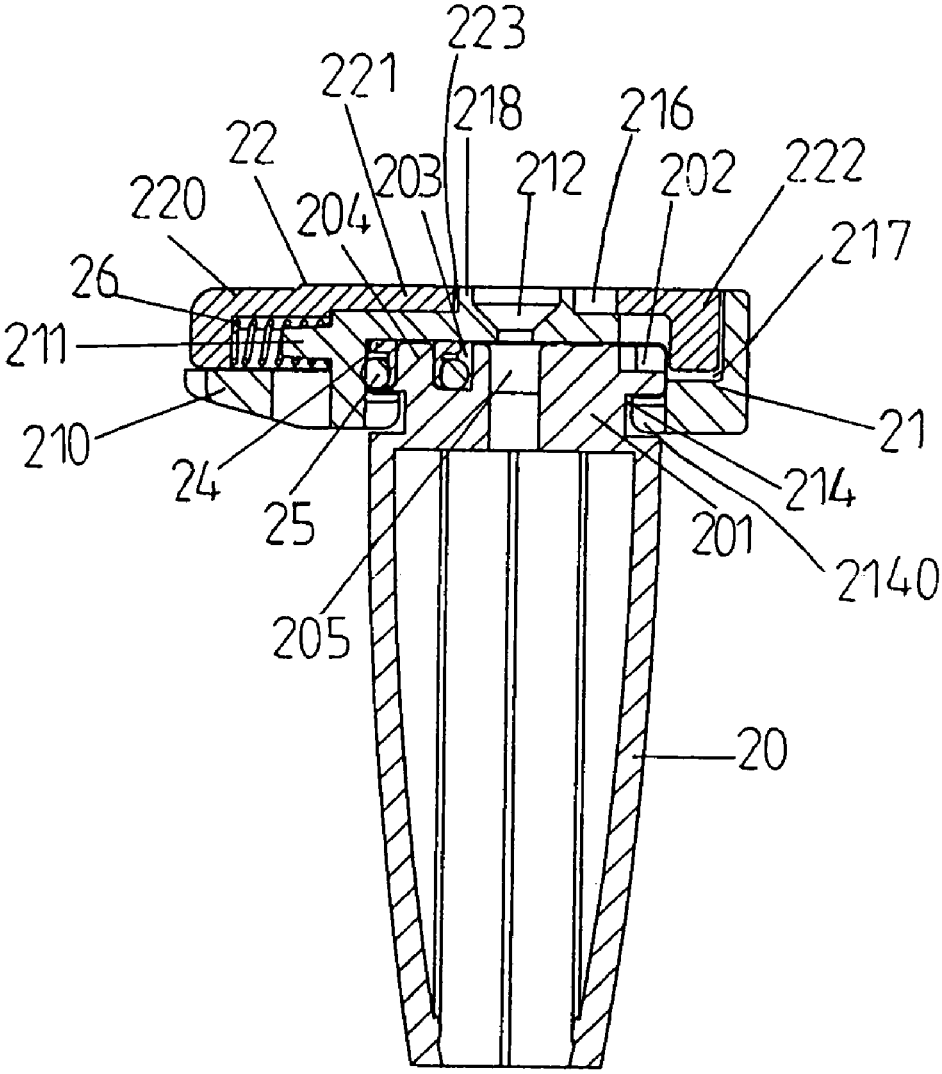
FIG. 7 is a schematic operational view of the armrest as shown in FIG. 5.
Figure 8:
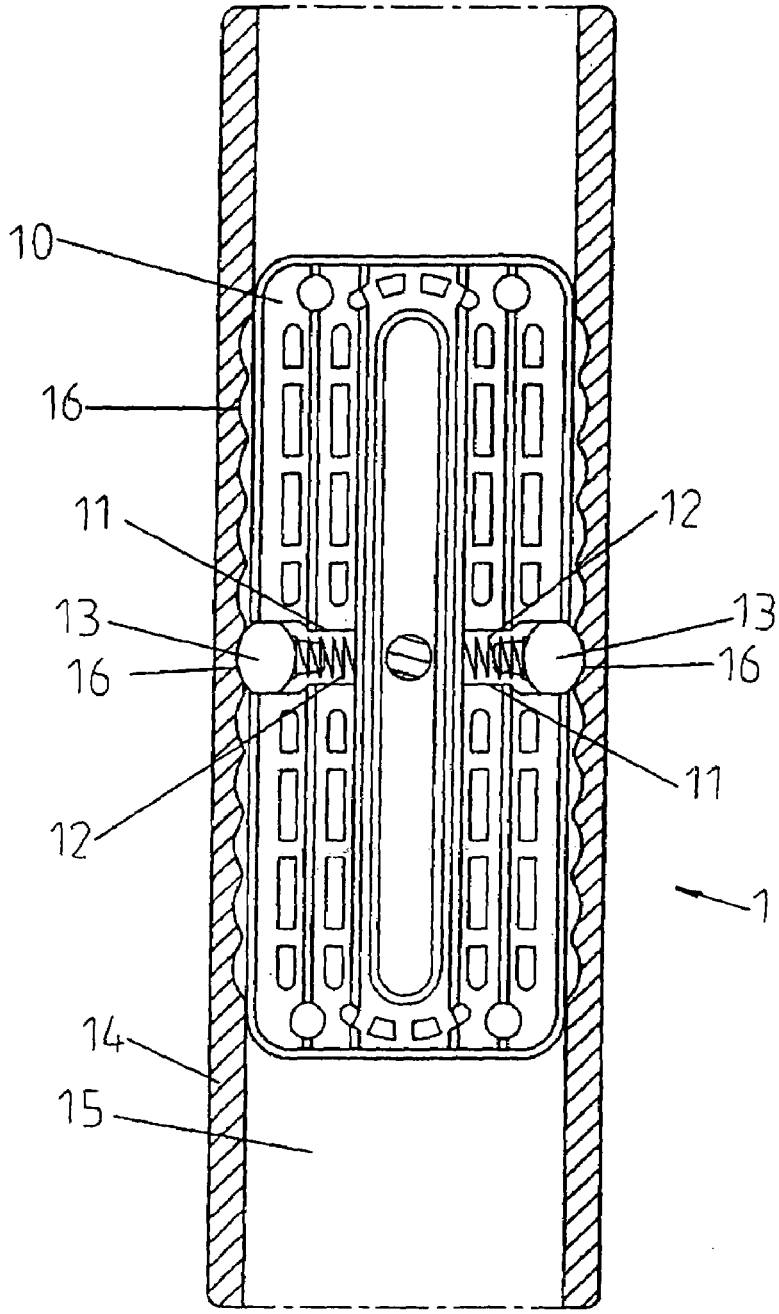
FIG.8 PRIOR ART
FIG. 8 is a top cross-sectional view of a conventional armrest in accordance with the prior art.

As shown in FIGS. 4 and 5, the push portion 220 of the push button 22 is pushed outwardly relative to the sliding seat 21 by the spring 26, and the locking portion 222 of the push button 22 is movable toward the locking seat 201 of the armrest support 20 so that the locking portion 222 of the push button 22 is locked in one of the locking grooves 202 of the locking seat 201 at a normal state to lock the sliding seat 21 on the locking seat 201 of the armrest support 20.

In operation, referring to FIGS. 1-7, when the push portion 220 of the push button 22 is pressed toward the sliding seat 21 to overcome the elastic force of the spring 26, the locking portion 222 of the push button 22 is movable outwardly relative to the locking seat 201 of the armrest support 20 and detachable from the respective locking groove 202 of the locking seat 201 to unlock the sliding seat 21 from the locking seat 201 of the armrest support 20, so that the sliding seat 21 is movable relative to the locking seat 201 of the armrest support 20 so as to adjust the position of the armrest body 23 relative to the armrest support 20.

After the force applied on the push portion 220 of the push button 22 disappears, the push portion 220 of the push button 22 is pushed outwardly relative to the sliding seat 21 by the restoring force of the spring 26, and the locking portion 222 of the push button 22 is movable toward the locking seat 201 of the armrest support 20 so that the locking portion 222 of the push button 22 is locked in another one of the locking grooves 202 of the locking seat 201 to lock the sliding seat 21 on the locking seat 201 of the armrest support 20 again.

Accordingly, the locking portion 222 of the push button 22 is detached from the respective locking groove 202 of the locking seat 201 when the sliding seat 21 is movable relative to the locking seat 201 of the armrest support 20 so that the sliding seat 21 will not rub the locking seat 201 of the armrest support 20 during movement of the sliding seat 21, thereby preventing from producing a noise during adjustment of the position of the armrest body 23 relative to the armrest support 20. In addition, the sliding seat 21 is unlocked from the locking seat 201 of the armrest support 20 by pressing the push portion 220 of the push button 22, so that a user can adjust the position of the armrest body 23 relative to the armrest support 20 easily and quickly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An armrest, comprising:

an armrest support having a top provided with a locking seat which has a first side formed with a plurality of locking grooves;

a sliding seat movably mounted on the locking seat of the armrest support;

a push button movably mounted on the sliding seat and having a first end formed with a locking portion extended through the sliding seat and detachably locked in one of the locking grooves of the locking seat and a second end formed with a push portion protruded outwardly from the sliding seat;

an armrest body secured on the sliding seat to move the sliding seat relative to the locking seat of the armrest support.

2. The armrest in accordance with claim 1, wherein the locking portion of the push button is inverted L-shaped.

3. The armrest in accordance with claim 1, wherein the push button is retained on the sliding seat to move with the sliding seat.

4. The armrest in accordance with claim 1, wherein when the push portion of the push button is pressed toward the sliding seat, the locking portion of the push button is movable outwardly relative to the locking seat of the armrest support and detachable from the respective locking groove of the locking seat to unlock the sliding seat from the locking seat of the armrest support, so that the sliding seat is movable relative to the locking seat of the armrest support.

5. The armrest in accordance with claim 1, wherein the sliding seat has a bottom formed with a channel mounted on the locking seat of the armrest support.

6. The armrest in accordance with claim 5, wherein the channel of the sliding seat is formed with two inwardly extending limit flanges rested on the locking seat of the armrest support to prevent the sliding seat from being detached from the locking seat of the armrest support.

7. The armrest in accordance with claim 1, wherein the armrest body has a bottom formed with a mounting recess mounted on the sliding seat.

8. The armrest in accordance with claim 7, wherein the sliding seat has two opposite ends each formed with a fixing hole, the mounting recess of the armrest body has a wall formed with two screw holes, and the armrest further comprises two locking screws each extended through a respective fixing hole of the sliding seat and each screwed into a respective screw hole of the armrest body to fix the armrest body on the sliding seat.

9. The armrest in accordance with claim 1, wherein the locking seat of the armrest support has a second side formed with a receiving groove to receive a roller and a ring.

10. The armrest in accordance with claim 9, wherein the roller and a ring are located between the sliding seat and the locking seat of the armrest support to facilitate movement of the sliding seat.

11. The armrest in accordance with claim 9, wherein the receiving groove of the locking seat is formed with a post for mounting the roller and the ring.

12. The armrest in accordance with claim 1, wherein the sliding seat has a first side formed with an elongated sliding slot connected to one of the locking grooves of the locking seat to allow sliding movement of the locking portion of the push button and a second side formed with a support bracket to support the push portion of the push button.

13. The armrest in accordance with claim 12, wherein the support bracket of the sliding seat has two opposite sides each formed with a slideway, and the push portion of the push button has two opposite sides each formed with a slide slidable in the slideway of the support bracket.

14. The armrest in accordance with claim 12, wherein the second side of the sliding seat is formed with a stub for mounting a spring which is biased between the sliding seat and the push portion of the push button to push the push portion of the push button outwardly relative to the sliding seat.

15. The armrest in accordance with claim 14, wherein the locking portion of the push button is movable toward the locking seat of the armrest support by an elastic force of the spring so that the locking portion of the push button is locked in one of the locking grooves of the locking seat at a normal state to lock the sliding seat on the locking seat of the armrest support.

16. The armrest in accordance with claim 12, wherein the sliding seat has a top formed with a receiving chamber connected to the sliding slot to receive the first end of the push button.

17. The armrest in accordance with claim 16, wherein the locking seat of the armrest support has a mediate portion formed with an axially extending elongated guide slot, the receiving chamber of the sliding seat is formed with a guide tube having an inside formed with a screw bore connected to the guide slot of the locking seat, and the armrest further comprises a guide screw screwed into the screw bore of the sliding seat and slidable in the guide slot of the locking seat to guide movement of the sliding seat.

18. The armrest in accordance with claim 17, wherein the locking seat of the armrest support has a second side formed with a receiving groove to receive a roller and a ring, and the guide slot of the locking seat is located between the locking grooves and the receiving groove.

19. The armrest in accordance with claim 17, wherein the first end of the push button is formed with an elongated sliding hole mounted on the guide tube of the sliding seat to allow sliding movement of the guide tube of the sliding seat.

20. The armrest in accordance with claim 19, wherein the sliding hole of the push button is located between the push portion and the locking portion.

* * * * *